US009003945B2

(12) United States Patent
Vallee et al.

(10) Patent No.: US 9,003,945 B2
(45) Date of Patent: Apr. 14, 2015

(54) PROTECTION GRID

(75) Inventors: Daniel J. C. Vallee, Guyancourt (FR); Didier Mallat, Gallardon (FR)

(73) Assignee: Nexter Systems, Roanne (FR)

( * ) Notice: Subject to any disclaimer, the term of this patent is extended or adjusted under 35 U.S.C. 154(b) by 0 days.

(21) Appl. No.: 13/980,337

(22) PCT Filed: Jan. 25, 2012

(86) PCT No.: PCT/FR2012/000032

§ 371 (c)(1),
(2), (4) Date: Aug. 15, 2013

(87) PCT Pub. No.: WO2012/098317

PCT Pub. Date: Jul. 26, 2012

(65) Prior Publication Data

US 2013/0312596 A1 Nov. 28, 2013

(30) Foreign Application Priority Data

Jan. 21, 2011 (FR) ..... 11 00191

(51) Int. Cl.
*F41H 7/02* (2006.01)
*F41H 5/02* (2006.01)

(52) U.S. Cl.
CPC ..... *F41H 5/026* (2013.01)

(58) Field of Classification Search
CPC ..... F41H 7/04; F41H 7/02; F41H 5/24; F41H 5/023; F41H 5/026
USPC ..... 89/36.02, 36.04, 36.09, 36.08, 920, 930
See application file for complete search history.

(56) References Cited

U.S. PATENT DOCUMENTS

| | | | | |
|---|---|---|---|---|
| 5,007,326 | A | 4/1991 | Gooch, Jr. et al. | |
| 7,191,694 | B1 * | 3/2007 | Gonzalez | 89/36.02 |
| 7,882,776 | B2 * | 2/2011 | Medwell et al. | 89/36.02 |
| 7,975,594 | B2 * | 7/2011 | Wartmann | 89/36.02 |
| 8,402,878 | B2 * | 3/2013 | Schreiner et al. | 89/36.08 |
| 2008/0257141 | A1 * | 10/2008 | Medwell et al. | 89/36.02 |
| 2009/0266227 | A1 | 10/2009 | Farinella et al. | |
| 2010/0206158 | A1 * | 8/2010 | Neethling | 89/36.02 |
| 2010/0288114 | A1 * | 11/2010 | Soukos | 89/36.02 |
| 2011/0113952 | A1 * | 5/2011 | Rosenwasser et al. | 89/36.02 |
| 2011/0120294 | A1 * | 5/2011 | Beach et al. | 89/36.02 |
| 2011/0232472 | A1 * | 9/2011 | Kellner et al. | 89/36.08 |
| 2012/0011993 | A1 * | 1/2012 | Malone et al. | 89/36.02 |

(Continued)

FOREIGN PATENT DOCUMENTS

| | | |
|---|---|---|
| EP | 1 574 810 A1 | 9/2005 |
| FR | 1103549 | 11/1955 |

(Continued)

OTHER PUBLICATIONS

Apr. 18, 2012 Search Report issued in International Patent Application No. PCT/FR2012/000032.

*Primary Examiner* — Bret Hayes
*Assistant Examiner* — Joshua Freeman
(74) *Attorney, Agent, or Firm* — Oliff PLC

(57) ABSTRACT

The invention relates to protection grid against a projectile, for example of the rocket type that incorporates a body extended by a fuse, said grid incorporating bars linked together by uprights, and is characterized in that said grid is formed in a single piece and is of a thickness that is less than three times the thickness of a bar, the section of a bar and uprights being polygonal with square edges.

15 Claims, 3 Drawing Sheets

(56) References Cited

U.S. PATENT DOCUMENTS

| | | | | |
|---|---|---|---|---|
| 2012/0180640 | A1* | 7/2012 | Farinella et al. | 89/36.08 |
| 2014/0123842 | A1* | 5/2014 | Kahmann et al. | 89/36.02 |
| 2014/0123843 | A1* | 5/2014 | Leeming | 89/36.02 |

FOREIGN PATENT DOCUMENTS

| | | | |
|---|---|---|---|
| GB | 2 448 477 | A | 10/2008 |
| WO | WO 2010/036411 | A2 | 4/2010 |

* cited by examiner

A-A

PROTECTION GRID

The technical scope of the invention is that of ballistic shield devices against projectiles and in particular rockets.

The protection of military vehicles against rocket attacks, in particular shaped charges, is at present ensured in full or in part by flat grids or grills, commonly termed "slats".

The common functioning principle of these devices is to damage the nose cone of a rocket so as to produce a short circuit in the firing system of the projectile's warhead. To do this, more often than not, such protection incorporates parallel metallic blades of a width of between 30 and 40 mm for a thickness of between 2 and 5 mm.

As disclosed in patent FR-1103549, these blades damage the nose cone impacting on them. The worst case in which the rocket is ignited only occurs when the rocket's piezoelectric fuse directly strikes a blade or portion of the structure of the protection device. To overcome this, the opposing edge of the blades is as narrow as possible to as to statistically limit the probability of the fuse hitting this edge.

This solution works for a frontal attack or one which is substantially perpendicular to the plane of the protection device. However, the smaller the elevation angle between the plane of the device and the projectile's trajectory, the wider the opposing edge of a blade device, thereby increasing the probability of the rocket fuse striking a blade.

A protection device is also known by patent US2009266227 in which hard steel or tungsten inserts are positioned in an array over a net of thin cables. The purpose of the inserts is to deteriorate the nose cone of the projectile in order to neutralize it.

Such a solution, light but complicated in structure, requires the cables to be flexible enough for the projectile to be brought into contact with the hard inserts.

Furthermore, the presence of a peripheral frame to hold the net in place strongly reduces the protection efficiency when the angle between the plane of the screen and the impact trajectory is small.

Patent GB2448477 discloses a light grill acting as a ballistic shield against rockets. This grill incorporates flat bars made of carbon fiber and fixed to uprights of light alloy. This grill also neutralizes rockets by deteriorating their nose cone or fuse.

Such a solution, despite its lightness, is complicated in structure, and only provides protection against rockets fired substantially perpendicularly to the grill.

Perforated amour plates are also known by patents WO2010/036411 and U.S. Pat. No. 5,007,326 that provide protection against small caliber projectiles. These plates are equipped with holes of a reduced diameter (of around 12.5 mm) and are thus not able to deteriorate rocket nose cone to neutralize them. Rockets are systematically ignited after impacting such amour plates.

U.S. Pat. No. 7,191,694 proposes a shield device for the edges of the window openings of armored vehicles. Once again, such shielding incorporates oblong drill holes of reduced dimensions (5 mm wide, approximately) and is not able to neutralize a rocket.

Lastly, patent EP1574810 discloses multi-layered shielding whose external plate incorporates drill holes to provide protection against small caliber (less than 20 mm) projectiles. This plate is not able to neutralize an incident rocket.

The invention proposes to overcome such drawbacks by implementing a grid, rigid but of reduced thickness, that incorporates bars made of a hard material, for example a metal, and having sharp angles. The bars are joined by uprights.

The invention thereby ensures protection against rockets fired at different angles of incidence with respect to the plane of the grid.

The grid according to the invention has the advantage of opposing a small surface to low elevation angles of attack whilst being aggressive enough to damage the nose cone of a rocket.

A second advantage lies in its small size which makes it light, easy to handle and store.

A third advantage lies in the fact that the grid can be made contiguously, as a single piece, by laser cutting or by die-stamping in a steel plate. The manufacture of the grid is thus made simpler.

A fourth advantage linked to this single-piece manufacture is that the grid is less subject to fractures between uprights and bars since there is no material discontinuity at this level.

A fifth advantage lies in the alternate spacing of the uprights thereby reducing their number and reducing the probability of the fuse hitting an upright and making the grid self-supporting (no need for a frame as for the cable-based device).

Thus, the invention relates to a protection grid against a projectile, for example of the rocket type that incorporates a body extended by a fuse, such grid incorporating bars linked together by uprights, the width between the bars being between the maximal diameter of the fuse and the maximal diameter of the projectile body, protection grid wherein the grid is formed in a single piece and the grid has a thickness that is less than three times the thickness of a bar, the section of the bar and uprights being polygonal with square edges.

According to one characteristic of the invention, the thickness of the grid is less than 15 mm.

Advantageously, the hardness of the material composing the grid is greater than 350 HRB.

Advantageously, the uprights are arranged alternately, from one row of bars to another, over the full grid.

According to one embodiment of the invention, the grid is plane.

Advantageously, the grid is constant in thickness.

According to another characteristic of the invention, the grid may incorporate at least one plane attachment zone provided with at least one drill hole.

The invention will become more apparent from the following description, description illustrated by the appended drawings, in which.

Figure 1:
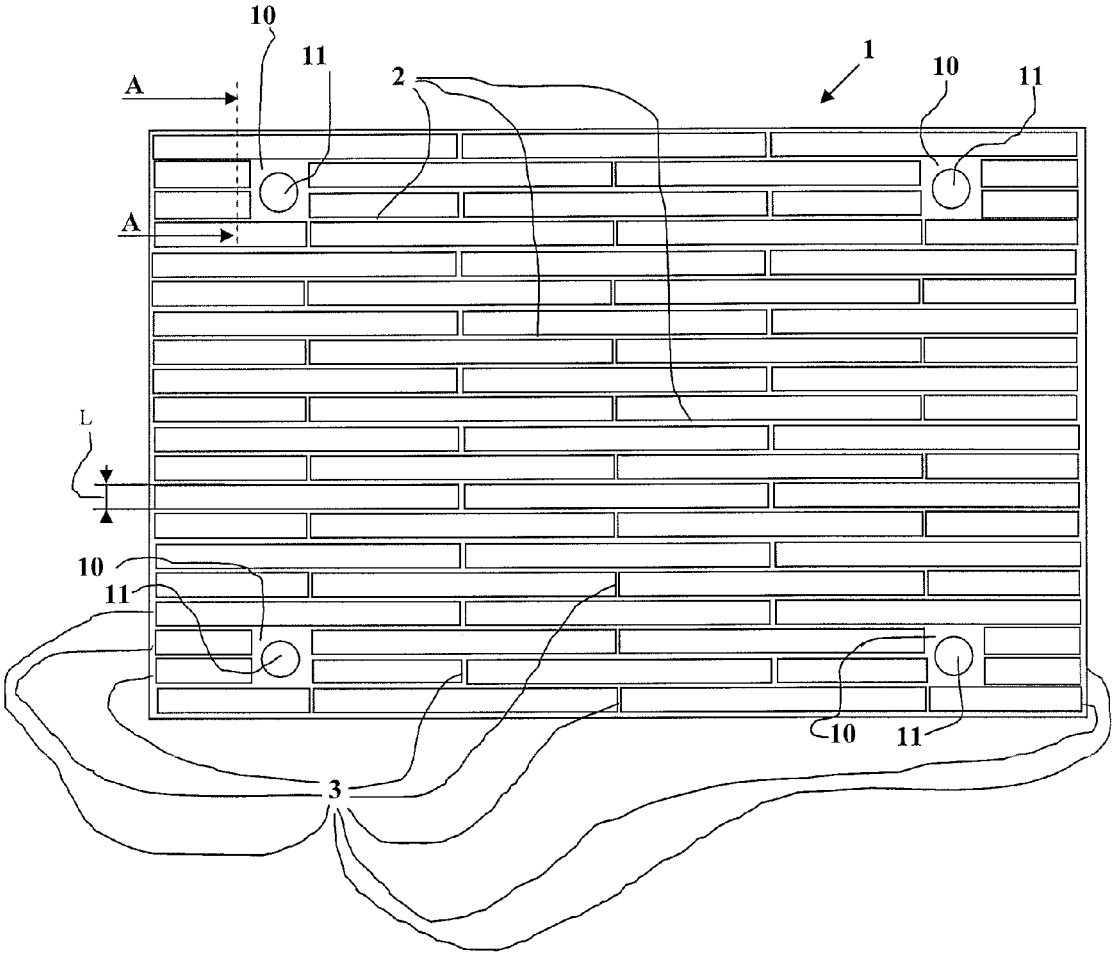
FIG. 1 represents a frontal view of the grid according to the invention.

According to FIG. 1, a grid 1 according to a first embodiment of the invention incorporates parallel horizontal bars 2. These bars 2 are linked together by uprights 3. The uprights 3 are here also present at each of the ends of the bars 2.

The width L between the bars is of between the maximal diameter of a fuse of a projectile (not shown, for example a rocket) and the maximal diameter of the body of this projectile. These dimensions are well known to one skilled in the art and namely by U.S. Patent Application Publication No. 2009/0266227 (quoted as prior art) which specifies that the dimensions of the meshing of a net able to stop a rocket are of between 110 and 180 mm and that the protection must be positioned at a distance of around 60 cm from the structure to be shielded.

Such a grid arrangement is well known and is intended to ensure the passage of the fuses of these projectiles between the bars whereas the body of the projectile itself is stopped by the grid. This results in a substantial shock at the nose of the projectile linking the fuse and the body, thereby leading to the destruction of the priming means. The projectile is thus not ignited and is neutralized.

The uprights are spaced alternately from one row of bars to another over the surface of the grid 1. In this way, it is possible for less uprights 3 to be used than if they were aligned from one row to another.

The grid 1 is in a single piece, which means it is made contiguously, for example by laser cutting or by stamping from a steel plate of a constant thickness. The grid can also be made by welding or mechanical assembly of the uprights 3 and the bars 2. Manufacture by laser cutting is the simplest since it limits the number of manufacturing operations and above all procures improved solidity of the grid 1 which thereby finds the number of its weaknesses, located at the intersections between the bars 2 and uprights 3, reduced.

Figure 2:
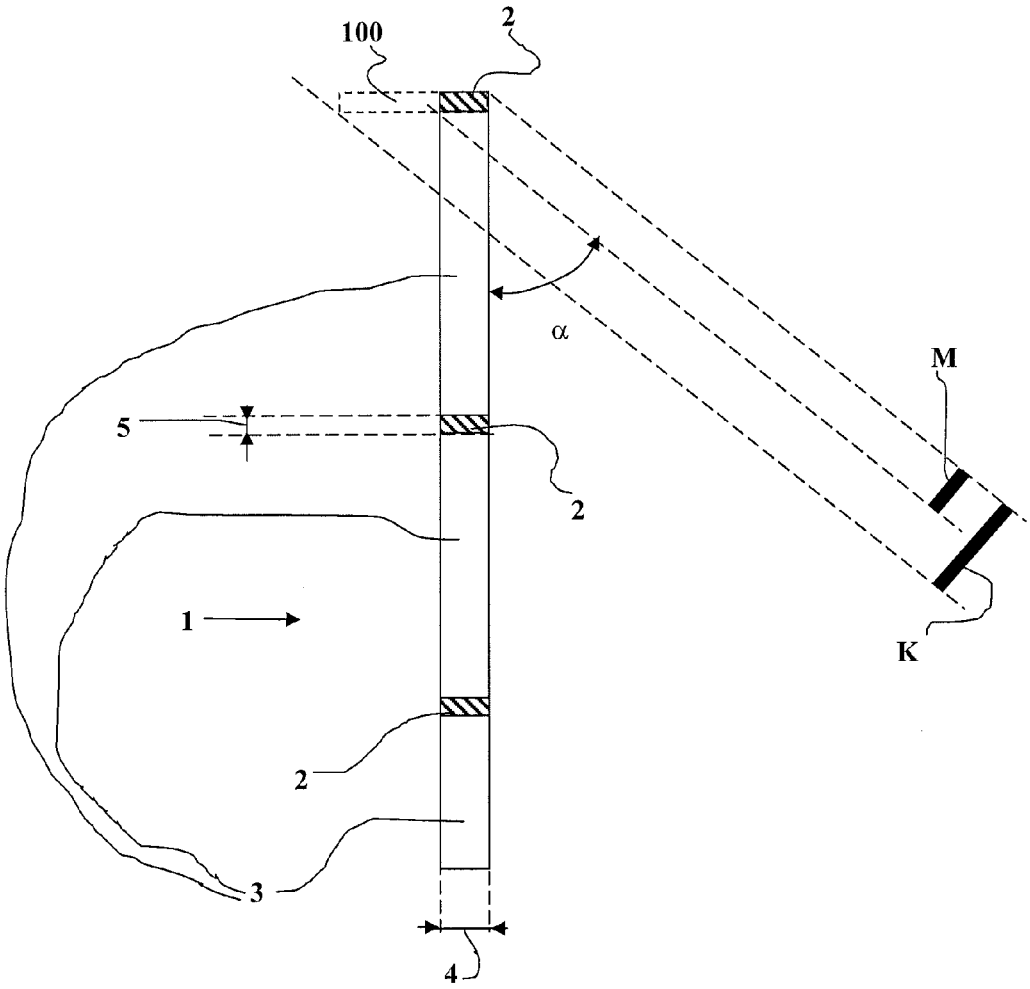
FIG. 2 represents a partial view of a section of the grid along the plane referenced A-A in FIG. 1.

According to FIG. 2, the grid 1 is plane and has no localized excess thicknesses. The bars 2 have a polygonal section with substantially rectangular edges. The thickness 4 of the grid 1 is less than three times the thickness 5 of a bar 2. The uprights 3 are also of a thickness equal to that of the bars. The thickness 4 of the grid is preferably less than 15 mm.

The grid 1 incorporates plane attachment zones 10 (FIG. 1) incorporating a drill hole 11 intended to provide an interface for the grid 1 with the support elements integral with the vehicle (support elements and vehicle not being shown). These zones will also be easily produced by cutting.

The grid 1 is made of a material with a superficial hardness of over 350 HRB (by which is conventionally designated Rockwell Hardness B defined by standard ISO 6508-1).

The bars thus obtained have sharp edges able to penetrate the body of a projectile level with its nose whatever the firing angles.

For an elevation angle of attack a with respect to the plane of the grid 1, when the width M exposed by a bar 2 of the grid 1 according to the invention is compared with the width K exposed by a bar of classical design 100 (second bar 100 drawn in dotted lines), it can be observed that the width M exposed is much less than the second width K exposed by a bar 100 of classical design.

The uprights 3 can be observed to have the same sectional characteristics as the bars 3 and because of this they have the same properties and also contribute to the aggression of the nose cone in addition to enabling the grid to be self-supporting and avoiding the necessity of having supporting frames or structures.

Figure 3:
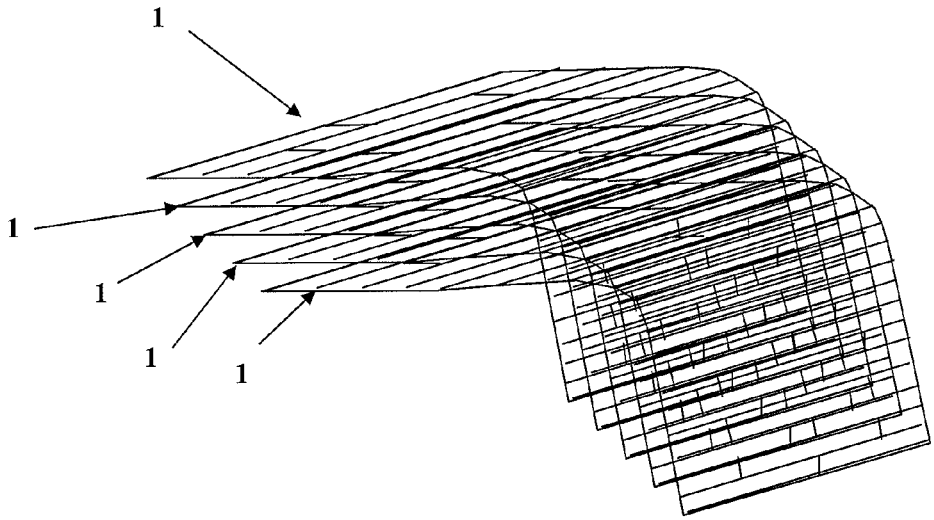
FIG. 3 shows a three-quarter view of a stack of grids according to a second embodiment of the invention.

According to FIG. 3 and according to a second embodiment of the invention, the grid 1 can have an overall curved or angular profile obtained by bending. Because of its design, the grid 1 has no protuberances or excess thicknesses, thereby enabling easy stacking and handling.

The invention claimed is:

1. A protection grid for protecting against a rocket type projectile having a body extended by a fuse, the grid comprising:

a plurality of rectangular uprights; and a plurality of rectangular bars linked together by the plurality of uprights, a width between the bars being a maximal diameter of the fuse and a maximal diameter of the body of the projectile, wherein:

the bars and the uprights each have a polygonal cross-section with square edges and are formed of the same width, the cross-section of the bars is formed of a determined thickness and of a determined width which is less than three times the thickness of the bars, and the protection grid is formed in a single piece and is formed of a thickness corresponding to the width of the bars.

2. The protection grid according to claim 1, wherein the thickness of the grid is less than 15 mm.

3. The protection grid according to claim 1, wherein the grid is composed of a material with a hardness greater than 350 HRB.

4. The protection grid according to claim 1, wherein the plurality of uprights are each arranged between two bars and disposed alternately according to a plurality of rows, over the full grid.

5. The protection grid according to claim 1, wherein the grid is plane.

6. The protection grid according to claim 1, wherein the grid is constant in thickness.

7. The protection grid according to claim 1, wherein the grid incorporates at least one plane attachment zone provided with at least one drill hole.

8. The protection grid according to claim 4, wherein the uprights are disposed at each of the ends of the bars.

9. The protection grid according to claim 1, wherein the protection grid is positioned at a determined distance from a shielded structure.

10. The protection grid according to claim 1, wherein the cross-section of any one of the plurality of bars is the same along each bar.

11. The protection grid according to claim 10, wherein the cross-section of any one of the plurality of uprights is the same along each upright.

12. The protection grid according to claim 1, wherein said cross-section is rectangular.

13. The protection grid according to claim 1, wherein the protection grid is made of metal and formed by laser cutting or by stamping.

14. The protection grid according to claim 4, wherein the protection grid is made of metal and formed by laser cutting or by stamping.

15. The protection grid according to claim 11, wherein the cross-section of the uprights is the same as the cross-section of the bars.

* * * * *

UNITED STATES PATENT AND TRADEMARK OFFICE

CERTIFICATE OF CORRECTION

PATENT NO. : 9,003,945 B2
APPLICATION NO. : 13/980337
DATED : April 14, 2015
INVENTOR(S) : Daniel Vallee et al.

It is certified that error appears in the above-identified patent and that said Letters Patent is hereby corrected as shown below:

Claims

Column 4, line 7, Claim 1, after “being” insert --between--.

Signed and Sealed this
Eighth Day of December, 2015

Michelle K. Lee

Michelle K. Lee
*Director of the United States Patent and Trademark Office*